US005667428A

United States Patent [19]

Lunn

[11] Patent Number: 5,667,428

[45] Date of Patent: Sep. 16, 1997

[54] APPARATUS FOR CUTTING AND GRINDING A WORKPIECE

[76] Inventor: Garfield R. Lunn, 455 Dalhousie St., Amherstburg, Ontario, Canada, N9V 1X4

[21] Appl. No.: 544,868

[22] Filed: Oct. 18, 1995

[51] Int. Cl.[6] ..... B24B 5/00; B24B 55/02; B26D 1/14; B26D 9/00

[52] U.S. Cl. ..... 451/70; 451/271; 451/294; 451/450; 451/461; 451/488; 451/516; 407/1; 407/51; 407/61

[58] Field of Search ..... 451/69, 70, 259, 451/271, 294, 449, 450, 461, 488, 514, 516, 517; 407/1, 42, 51, 61

[56] References Cited

U.S. PATENT DOCUMENTS

| | | | |
|---|---|---|---|
| 861,368 | 7/1907 | Juengst | 407/61 X |
| 1,284,092 | 11/1918 | Gray . | |
| 2,048,058 | 7/1936 | Comeau | 407/61 X |
| 2,454,992 | 11/1948 | Coleman . | |
| 2,949,946 | 8/1960 | Johnson | 407/61 X |
| 3,103,675 | 9/1963 | Vaughn | 407/61 X |
| 3,270,467 | 9/1966 | Block et al. | 451/514 X |
| 4,520,597 | 6/1985 | Lindberg | 451/294 X |
| 4,675,975 | 6/1987 | Kucharczyk et al. . | |
| 4,852,304 | 8/1989 | Honda et al. . | |
| 4,894,956 | 1/1990 | Honda et al. . | |
| 5,111,622 | 5/1992 | Steere, Jr. | 451/70 |
| 5,285,600 | 2/1994 | Shepley . | |

*Primary Examiner*—Timothy V. Eley
*Attorney, Agent, or Firm*—Burns, Doane, Swecker & Mathis, L.L.P.

[57] ABSTRACT

A machine for simultaneously milling and grinding a workpiece comprises milling and grinding wheels rotatable about respective first and second parallel axes, the second axis being offset radially with respect to the first axis. A single motor drives the milling and grinding wheels at different relative speeds. The grinding wheel is mounted to a hub which includes an axially flexible portion to enable the grinding surface to be axially adjusted. The milling wheel includes an array of milling cutters with a large gap formed between leading and trailing ones of the milling cutters to accommodate the offset grinding wheel. The radial spacing of the milling cutters from the axis of rotation of the milling wheel progressively increases from the leading milling cutter to the trailing milling cutter.

14 Claims, 4 Drawing Sheets

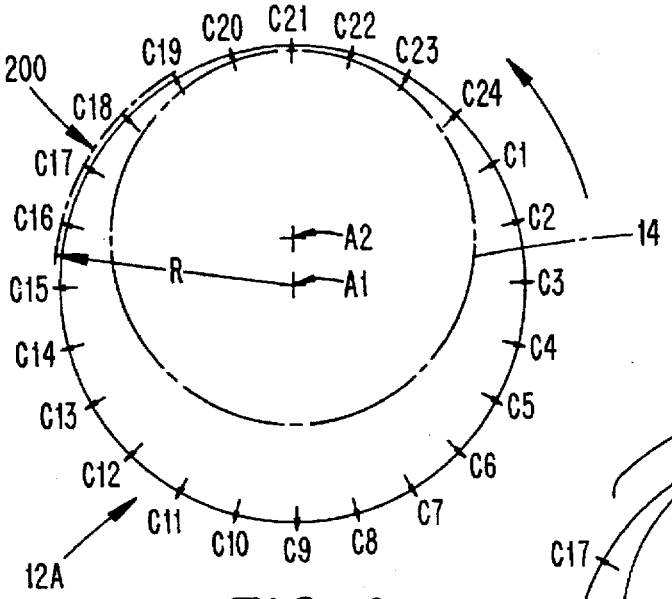
FIG. 4
(PRIOR ART)
FIG. 5
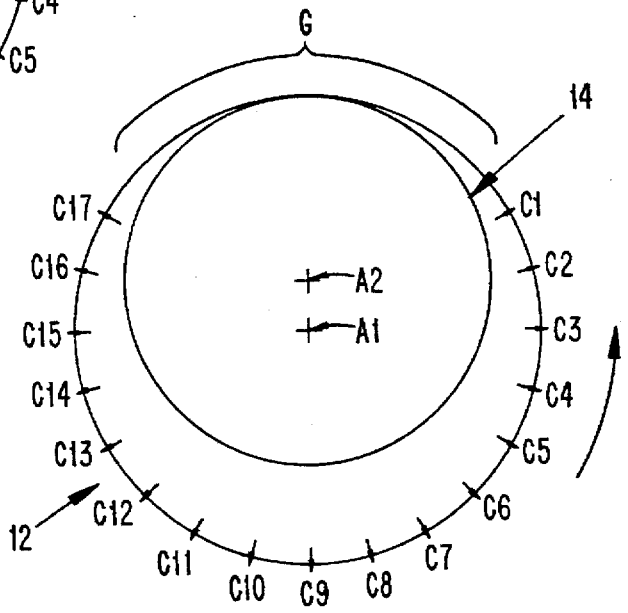
FIG. 6
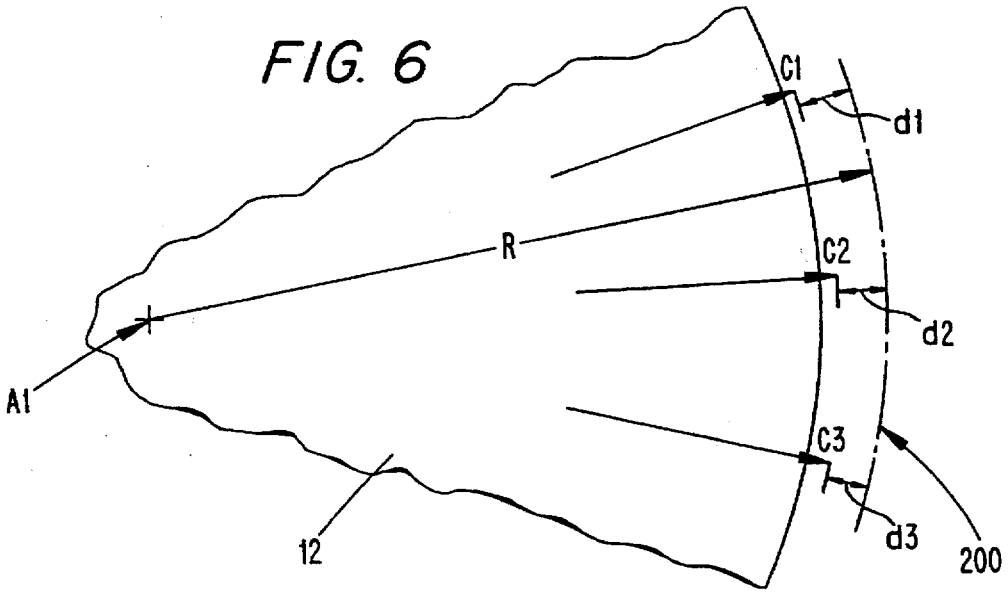

APPARATUS FOR CUTTING AND GRINDING A WORKPIECE

BACKGROUND OF THE INVENTION

The present invention relates to machines for finishing metal workpieces, e.g., for milling and then grinding a surface of the workpiece.

Machines for simultaneously milling and grinding a workpiece are known. Such a machine is disclosed, for example, in U.S. Pat. No. 5,285,600, which comprises a cutting ring having milling inserts mounted thereon, and a grinding wheel disposed coaxially inside of the cutting ring. The milling ring and grinding wheel are driven at different respective speeds about a common axis of rotation by means of respective drive motors. That machine can be employed to machine portions of metallic engine blocks, among other uses.

However, the machine exhibits certain shortcomings, one occurring when the machine is used to form a surface intended to support a steel sealing gasket. Steel gaskets are of less flexibility than other types of gaskets, e.g., fabric or rubber gaskets, whereby the surfaces between which the steel gasket is to be clamped must be highly smooth in order to prevent leakage. A surface cut by a rotary milling cutter will exhibit a "waviness" due to the creation of curved rings or scallops across its surface. The rings define grooves which enable fluid to leak past a steel gasket. The use of a coaxial grinding disc as described in the above-referenced prior art machine will reduce the height of such rings, but possibly not sufficiently to eliminate the need for performing an additional polishing step.

A second shortcoming of the above-described machine is evident in situations where the machine is used to finish a workpiece surface which terminates at a corner or shoulder defined by an upstanding wall of the workpiece, and wherein it is necessary that the surface be ground essentially right up to that corner. The milling cutters can be brought right up to the corner, but the coaxial grinding wheel cannot, due to the radial spacing which must be provided between the milling cutters and grinding wheel to allow the grinding wheel to rotate within the milling cutter. Hence, a separate grinding step may have to be performed to finish the surface right up to the corner.

A third shortcoming of the above-described prior art machine relates to a need to periodically adjust the axial relationship between the milling cutters and the grinding wheel as the milling cutters wear. In that machine, the axial adjustment is made by axially displacing the milling cutter relative to the grinding wheel. In particular, a cylindrical slide which carries the milling cutter spindle (which, in turn carries the milling cutter) and rotary bearings which support that spindle, are axially displaced by a hydraulic positioner. However, the bulk and weight of the slide, spindle, bearings and milling cutter make it difficult to achieve the required fine adjustments of the milling cutter.

Therefore, it would be desirable to provide a milling/grinding machine which eliminates the above-described shortcomings. It would also be desirable to increase the life of the spindle and bearings which support the grinding wheel, and to render the machine more compact in size and less costly to make.

SUMMARY OF THE INVENTION

The present invention relates to an apparatus for performing cutting and grinding operations on a workpiece. The apparatus comprises a hollow outer spindle driven about a first axis of rotation, a cutting ring mounted on a front end of the outer spindle for carrying cutters, an inner spindle disposed within the outer spindle and driven about a second axis which is offset from and parallel to the first axis, and a grinding wheel mounted on a front end of the inner spindle. The grinding wheel includes a front grinding surface capable of rotating about the second axis while orbiting about the first axis, during rotation of the cutting wheel about the first axis.

Preferably, a single motor is provided for driving both of the outer and inner spindles. A gear train connected to the motor drives the outer and inner spindles at relatively different speeds. The grinding surface is axially displaceable relative to the cutting wheel to adjust an axial relationship between the grinding surface and a cutting path of the cutters. The grinding wheel is mounted to a hub which includes a mounting portion mounted to the inner spindle, and an elastically flexible connector portion interconnecting the grinding surface and the mounting portion for effecting the axial adjustment of the grinding surface. An actuator is provided for controlling axial flexing of the mounting portion.

Another aspect of the present invention relates to the grinding mechanism, wherein the grinding surface can be axially adjusted by the axial flexing of the connector portion.

Yet another aspect of the invention relates to a milling cutter which comprises a body defining an axis of rotation, and a plurality of milling cutter elements mounted on the body in circumferentially spaced relationship. The cutter elements comprise leading and trailing cutter elements and intermediate cutter elements disposed therebetween. A circumferential distance from the leading cutter element to the trailing cutter element in a direction opposite a direction of rotation of the body is occupied by the intermediate cutter elements which are spaced circumferentially apart by generally equal intervals. A circumferential distance from the leading cutter element to the trailing cutter element in the direction of rotation is substantially greater than any of the intervals. The cutter elements are spaced radially from the axis by different radial distances. The leading cutter element has the smallest radial distance, and the trailing cutter element has the largest radial distance. The intermediate cutter elements have progressively increasing radial distances.

BRIEF DESCRIPTION OF THE DRAWINGS

The objects and advantages of the invention will become apparent from the following detailed description of a preferred embodiment thereof in connection with the accompanying drawing in which like numerals designate like elements and in which:

FIG. 4 is a schematic view representing an end of a conventional milling cutter wheel shown in solid lines, with an offset grinding wheel according to the present invention shown in phantom lines;

FIG. 5 is a view similar to FIG. 4 of a milling wheel in combination with an offset grinding wheel according to the present invention; and FIG. 6 is an enlarged fragmentary view of a portion of the milling wheel depicted in FIG. 5.

DETAILED DESCRIPTION OF A PREFERRED EMBODIMENT OF THE INVENTION

Figure 1:
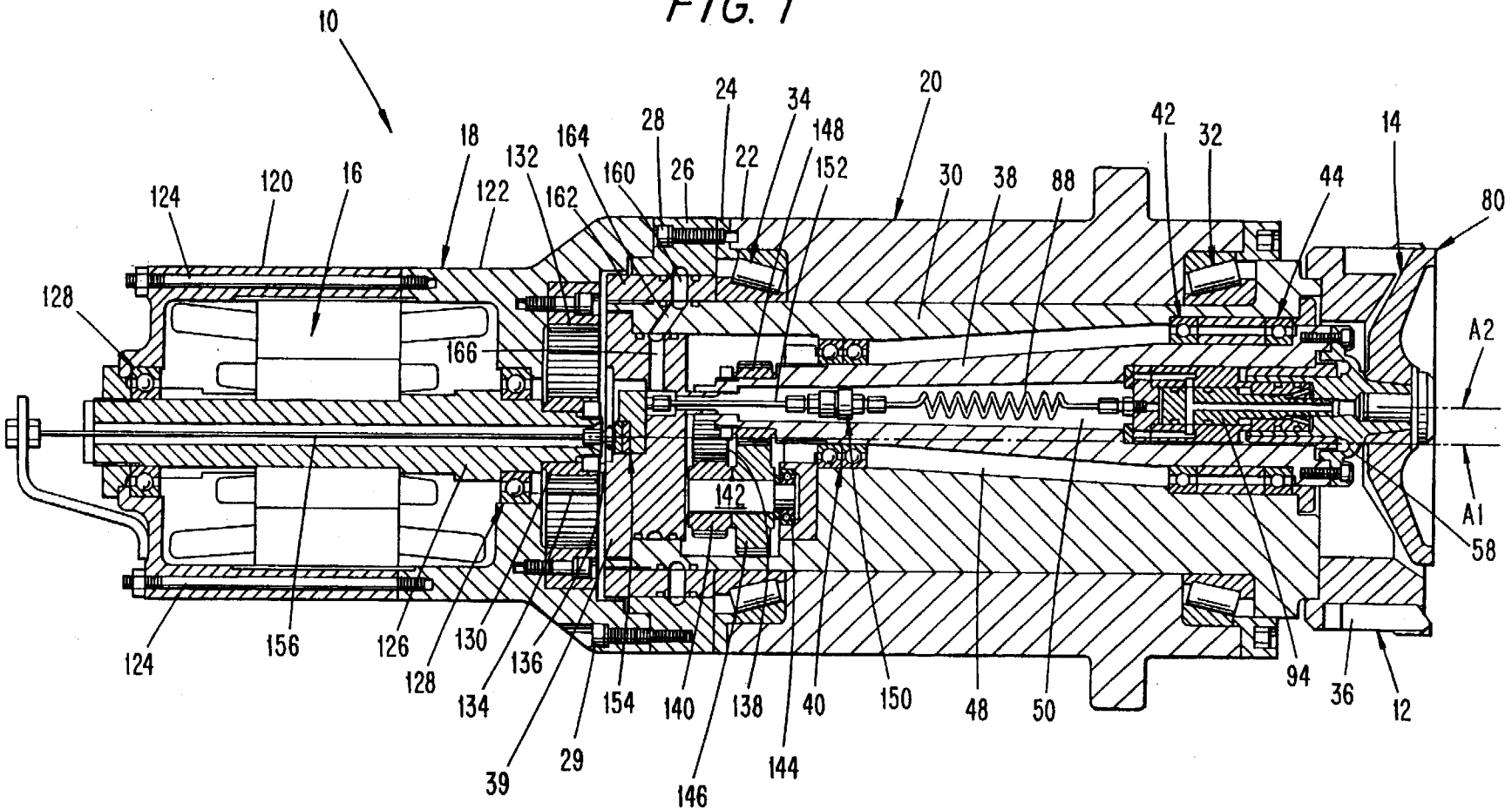
FIG. 1 is a longitudinal sectional view taken through a machine according to the present invention.

An apparatus 10 depicted in FIGS. 1–6 for finishing a workpiece comprises a cutting wheel or ring 12 and a grinding wheel 14 driven about respective axes of rotation A1, A2, respectively. The axes A1, A2 are oriented in parallel, radially spaced relationship and are driven by a common motor 16.

The motor 16 is mounted in a rear housing 18 that is fixedly connected to a front housing 20 in which the cutting and grinding wheels 12, 14 are mounted.

Interposed axially between the rear and front housings are a spacer plate 22, a bearing plate 24, and an intermediate plate 26. Axial bolts 28 secure the parts 20, 22, 24 and 26 together. Bolts 29 secure the rear housing 18 to the plate 26.

A hollow outer spindle 30 is rotatably mounted within the front housing 20 by axially spaced bearings 32, 34. The cutting wheel 12 is fixedly mounted, e.g., by bolts (not shown) to a front end of the outer spindle 30. The cutting wheel may comprise a milling cutter, wherein a plurality of conventional milling cartridges 36 are affixed at circumferentially spaced locations around the outer periphery of the milling cutter. Affixed at a rear end of the outer spindle 30 is an end plate 39.

A hollow inner spindle 38 is rotatably mounted in the outer spindle 30 by axially spaced bearings 40, 42, 44. The bearing 44 is axially retained by a retainer plate 46 (see FIG. 2).

The outer spindle 30 includes an eccentric outer cavity 48 in which the inner spindle 38 is disposed, so that the axis of rotation A2 of the inner spindle 38 is spaced radially from the axis of rotation of the outer spindle 30, as noted earlier herein. Disposed within the inner spindle 38 is an inner cavity 50 oriented coaxially relative to the axis A2 of the inner spindle 38.

Mounted on a front end of the inner spindle 38 is a grinding mechanism comprising the conventional grinding wheel 14 and a steel hub 58. The hub 58 includes a mounting portion 60 affixed by bolts 62 to a front face of the inner spindle 38, and also includes a nose portion 64 (see FIG. 2). A front end of the nose portion 64 includes a frusto-conical surface 66 on which the grinding wheel 14 is mounted. The attachment is made by an attachment screw 68 which threads into a threaded center bore 69 of the nose portion 64.

Interconnecting the mounting portion 60 and the nose portion 64 is intermediate portion 74 of the hub which is sufficiently thin to define an elastic portion. Formed in a rear end of the hub 58 is a rearwardly open cylindrical recess 76.

Situated within the inner cavity 50 of the inner spindle 38 is an actuator for axially adjusting a grinding face 80 of the grinding wheel 14 by controlling the axial flexure of the flexible intermediate portion 74. The actuator includes a cylinder 82 that is fixed, e.g., by bolts (not shown), to the inner spindle 38. Affixed to a rear end of the cylinder 82 is an end cap 84 which includes a fluid passage 86 for conducting pressurized fluid, such as air, from a delivery conduit 88. The delivery conduit 88 is connected to the passage 86 by a fitting 90.

A front end 83 of the cylinder 82 is of reduced outer diameter to extend into the recess 76 of the hub 58, whereby the hub 58 is axially slidable relative to the cylinder 82 within a hardened bushing 91 affixed to a front end of the inner spindle 38.

Axially slidably mounted in a center bore of the cylinder 82 is a piston 94. The outer diameter of the piston 94 is stepped down to form a shoulder 96 which faces an opposing shoulder 98 of the center bore. A compression spring 100 in the form of a stack of frusto-conical washers is disposed in a recess formed between the shoulders 96, 98.

The outer diameter of the piston 94 is again stepped down to form a nose 104 which is slidably disposed in a bore 106 of the hub 58. A fluid chamber 112 is formed between shoulders of the piston 94 and the cylinder 82 and contains oil. A plurality of passages 114 formed in the cylinder 82 communicate that chamber 112 with another chamber 116 formed in the recess 76, the recess being bordered by a front wall of the cylinder 82 and an end wall 115 of the recess 76.

Figure 2:
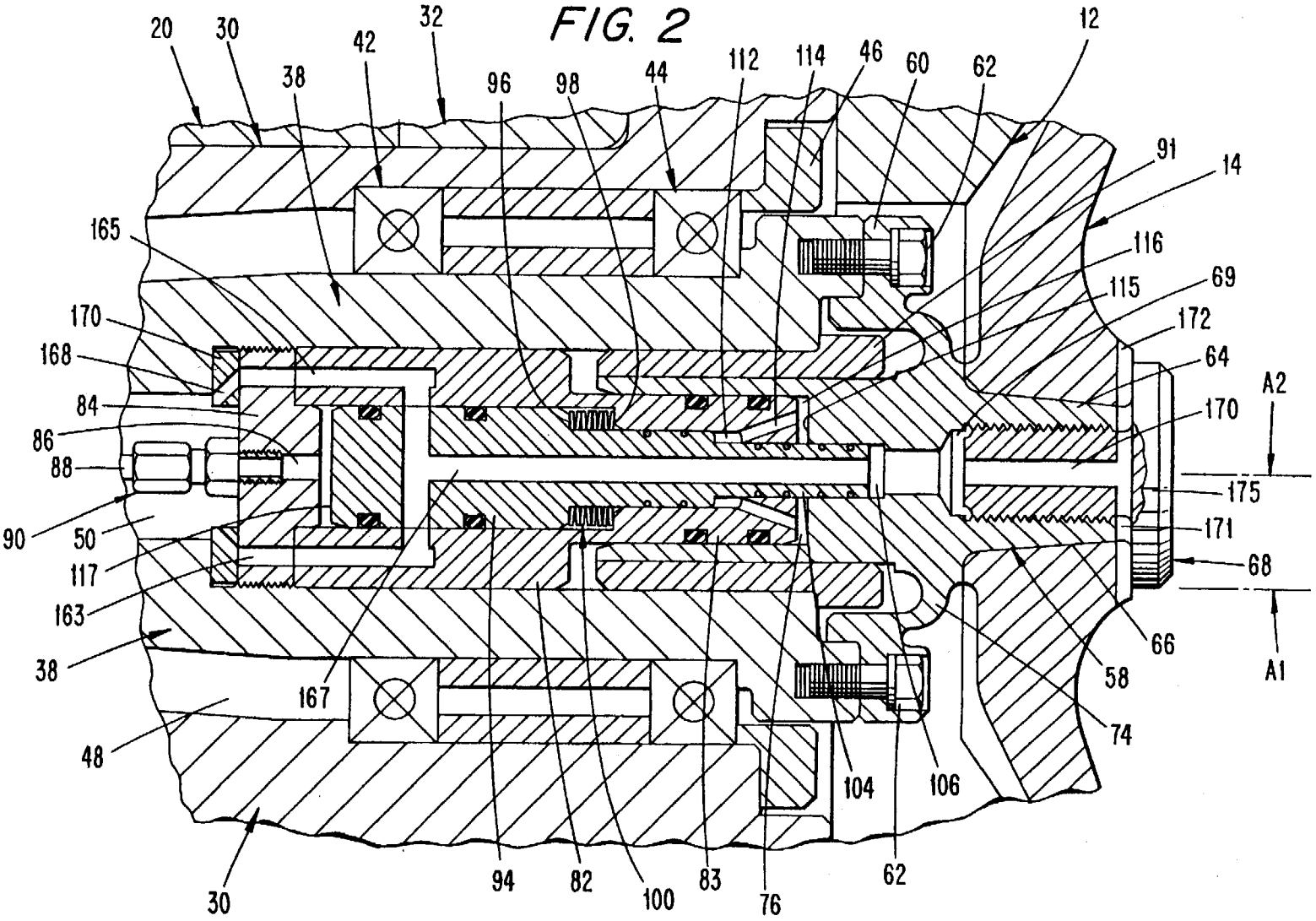
FIG. 2 is a fragmentary exploded view of a front portion of the machine depicted in longitudinal section in FIG. 1.
Figure 3:
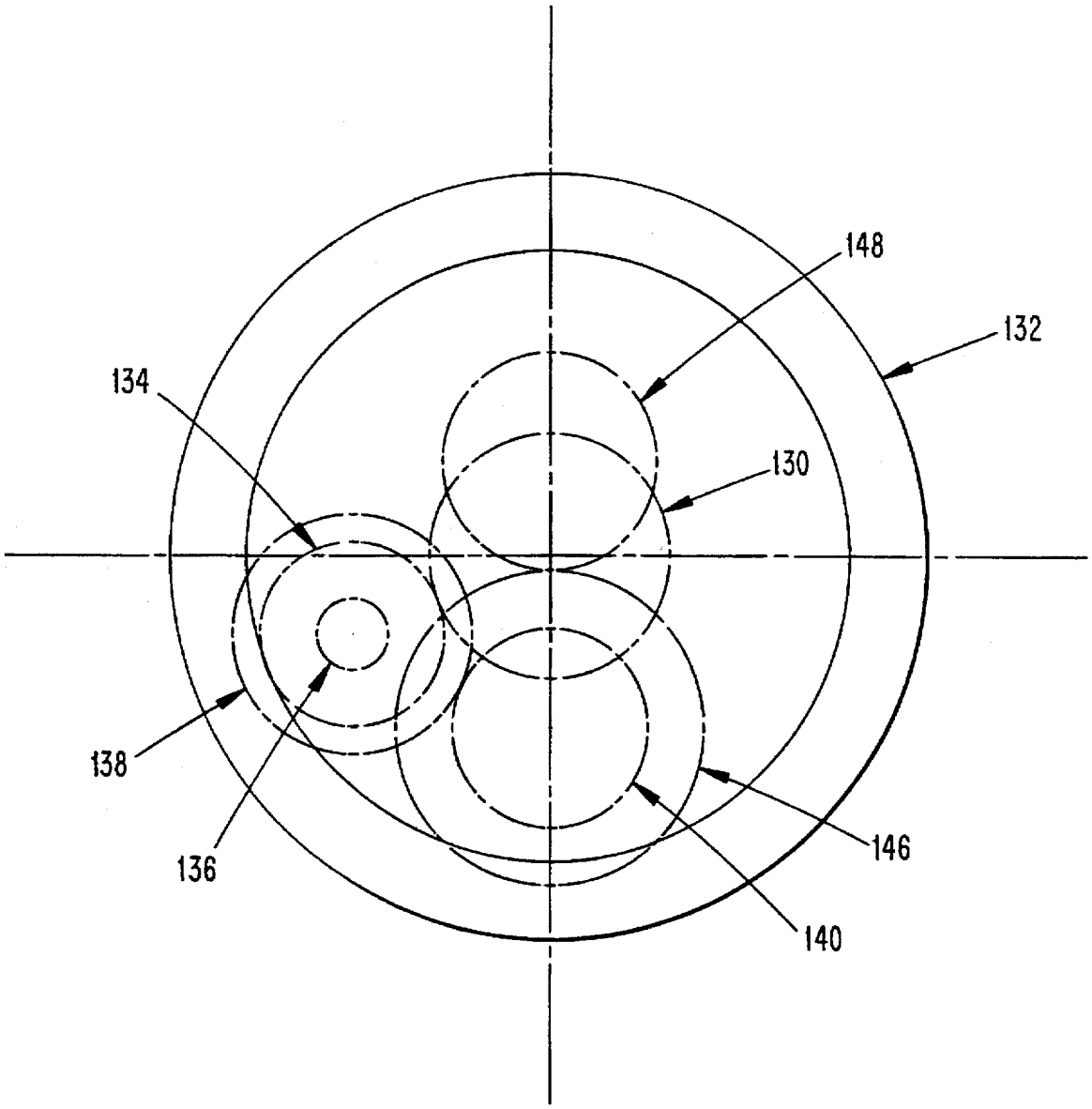
FIG. 3 is a schematic view representing the positional relationship of the gears of a gear train portion of the machine depicted in FIG. 1.

It will be appreciated that if compressed air is conducted through the conduit 88 to the passage 86, such air will impart a forward force to a rear surface 117 of the piston 94. Consequently, the oil in the chamber 112 will become pressurized and bear against the end wall 115 of the recess 76 of the hub 58 to force that hub axially forwardly. Such axial forward movement is permitted by the elasticity of the elastic intermediate portion 74. The normal at-rest or relaxed state of the elastic portion 74 is shown in FIG. 2, wherein the hub 58 is in an axial rearward position. By elastically displacing the hub 58 forwardly, the intermediate portion 74 tends to straighten out, thereby imparting a rearward bias to the hub 58.

In practice, prior to a grinding operation, the hub 58 is flexed forwardly until the grinding surface 80 is positioned at a proper axial spacing rearwardly of the cutting edges of the milling cutters 36. The workpiece finishing operation would then be performed. As the milling cutters 36 wear, the grinding surface 80 would be displaced rearwardly by partially relieving the air pressure in the conduit 88, thereby partially relieving the oil pressure in the chamber 112 to enable the elastic portion 74 to return the hub 58 partially to its rest state. As a result, the grinding surface 80 is moved axially rearwardly by an intended amount.

As pointed out earlier, the outer and inner spindles 30, 38 are driven by a common motor 16. The manner in which that is achieved will now be described.

The electric motor 16 is affixed to a back portion 120 of the rear housing 18, which portion 120 is bolted to a front portion 122 of the rear housing by bolts 124 (see FIG. 1). A hollow drive shaft 126 of the motor 16 is rotatably mounted in bearings 128. Fixedly mounted on a front end of the drive shaft is a drive gear 130. Fixedly mounted on a front end of the front portion 122 of the rear housing 18 is a stationary ring gear 132. The ring gear 132 and drive gear 130 are coplanar and coaxial (see also the schematic representation of the gear train shown in FIG. 3). The drive gear 130 rotates about the axis A1 of the outer spindle 30. Meshed with both of the ring and drive gears 132, 130 is a planetary gear 134. As the drive gear 130 is rotated, the planetary gear orbits about the axis A1 and simultaneously rotates about its own axis.

Affixed to the planetary gear 134 is a coaxial shaft 136 which extends through a hole (not shown) formed through the end plate 39 of the outer spindle 30. The shaft 136 is rotatably mounted in a pair of bearings (not shown) disposed in that hole. Hence, as the planetary gear 134 orbits about the axis A1, the shaft 136 rotates the end plate 39 (and outer spindle 30) about that axis A1. Affixed to an end of the shaft 136 disposed within the cavity 48 of the outer spindle is a first ratio gear 138. The first ratio gear 138 meshes with a second ratio gear 140 that is affixed to a journal 142. One end of the journal is rotatably mounted in a bearing (not shown) disposed in the end plate 39, and the other end of the journal 142 is rotatably mounted in a bearing 144 mounted in the outer spindle 30.

Also affixed to the journal 142 is a third ratio gear 146 which, in turn, meshes with a spindle gear 148 that is affixed to a rear end of the inner spindle 38. Thus, as the planetary gear 134 orbits about the axis A1 it not only rotates the outer spindle 30 about that axis A1, but it also rotates the inner spindle 38 about the axis A2. As the outer spindle 30 rotates about axis A1, it carries with it the inner spindle 38. Thus, the inner spindle (and the grinding surface 80) orbits about the axis A1 and simultaneously rotates about the axis A2. The speeds of rotation of the outer and inner spindles 30, 38 relative to one another are a function of the various gear ratios. Preferably, the grinding wheel 14 is rotated at a faster speed than the milling wheel 12.

As observed earlier, pressurized air is delivered to the actuator for the hub 58 through the conduit 88. That conduit 88, which rotates with the inner spindle 38 about the axis A2, is connected at its rear end by means of a rotary fluid connector 150 to a conduit 152. The conduit 152, which does not rotate about the axis A2, is connected to another rotary fluid coupler 154 mounted on the end plate 39 to accommodate the movement of the conduit 152 as it orbits with the conduit 88 and inner spindle 38. That coupler 154 is connected to a stationary supply conduit 156 which is connected to a suitable external source of pressurized air.

In order to cool and lubricate the grinding surface 80 and the milling cutters, cooling liquid is supplied from an external source through a passage 160 (see FIG. 1) formed in a plate 162 mounted on the outside of the outer spindle 30. That passage 162 is connected to a passage 164 formed in the outer spindle 30, and a passage 166 formed in the end plate 39. The passage 166 communicates with the inner cavity 50 and conducts the cooling fluid to slots 168 formed in a washer 170 disposed behind the end cap 84 of the cylinder 82 (see FIG. 2). Those slots 168 communicate with passages 163, 165, 167 formed in the end cap 84, cylinder 82, and piston 94, respectively, and is conducted through a passage 170 formed in the retaining screw 68.

Radial slots 171, 172 are formed in front faces of the nose 64 and grinding wheel 14, respectively, the slots 172 being covered by a head 175 of the retaining screw 68 to form radial passage that conduct the cooling fluid radially outwardly toward the grinding surface 80 and the milling cutters.

In operation, a workpiece finishing operation is performed by rotating the milling wheel 12 and grinding wheel 14 (the grinding wheel preferably rotating faster than the milling wheel) while advancing the machine relative to the workpiece surface in a direction perpendicular to the axis A1. The milling cutters remove material from the workpiece, and the grinding wheel smooths that surface, especially by removing rings formed in the workpiece surface by the milling cutters. The grinding surface 80 of the grinding wheel undergoes the following movements: (a) rotation about its own axis A2, (b) orbital movement about the axis A1 (along with the inner spindle 38), and (c) lateral movement along the workpiece surface as the machine is advanced in a direction perpendicular to the axis A1. That combination of movements of the grinding surface enables the rings or scallops created by the milling cutters to be broken up and evened out to create a sufficiently smooth surface for being sealed by a metal gasket, in contrast to the less satisfactory results achieved by a conventional coaxial grinding wheel which cannot undergo the orbital movement.

Additionally, due to its eccentric positioning relative to the axis A1, the grinding surface 80 is located very close to the cutting path of the milling cutters, and thus can closely approach a corner of the workpiece formed by the intersection of the workpiece surface with an upstanding surface of the workpiece. In one machine according to the invention, the grinding wheel is able to come within about ⅛ inch of that corner, as compared to about one inch achieved in a known coaxial machine. Hence, the need for a subsequent finishing step in certain cases would be avoided by the present invention.

It will also be appreciated that the overall area traveled by the grinding wheel due to the three combined movements described above will be greater than that covered by a conventional coaxial grinding wheel, whereby an increase in machine efficiency will result. This enables the rotational speed of the inner spindle 38 to be reduced which, in turn, results in the generation of less heat and wear. Accordingly, the life of that spindle and its bearings is increased.

The grinding surface 80 can be easily and precisely adjusted axially relative to the milling cutters by regulating the fluid pressure in the conduit 88 to control the flexure of the section 74 of the hub 58, by means of conventional pressure regulating instruments (not shown). This provides for convenient adjustment by a simple and inexpensive mechanism.

It will thus be appreciated that the present invention functions in a way that is not possible with conventional coaxial machines, and is thus able to produce smoother surfaces, eliminate additional polishing steps, and extend the life of certain components.

The present invention also involves a novel arrangement of milling cutters 36 on the milling wheel 12. That is, a conventional milling cutter 12A (FIG. 4) has an annular array of milling cutters (represented by arrows C1–C24) spaced apart at equally spaced circumferential intervals around its front face. Those cutters are arranged at an equal radial distance R from the axis of rotation of the milling wheel 12. As the machine advances along the workpiece surface in a direction perpendicular to the axis A1, the cutters cut an equal thickness of material from the workpiece.

As a result of the eccentric positioning of the grinding wheel 14 in accordance with the present invention (shown in phantom in FIG. 4), some of the milling cutters C18–C24 must be removed, leaving a large circumferential gap G between the leading cutter C1 and the trailing cutter C17 as can be seen in FIG. 5. Thus, it will be appreciated that if the cutters remained at equal radial distances from the axis of rotation A1 of the milling wheel 12, the leading cutter C1 would have to cut a relatively large thickness, i.e., a residual thickness, equal to the total thicknesses which would have otherwise been cut by the now-removed cutters C18–C24. This would impose an undesirably large instantaneous force on the leading cutter and the drive mechanism of the milling cutter.

In accordance with the present invention, the radial positions of the milling cutters are arranged so that each of the cutters cuts a portion of the afore-described residual thickness. For instance, assuming that there would have been twenty-four cutters C1–C24 in the conventional milling wheel, each cutting a thickness of x inches, and that seven of the cutters C18–C24 are displaced by the presence of the eccentric grinding wheel 14 (leaving seventeen cutters C1–C17), then the residual thickness not cut by the seven missing cutters C18–C24 would be 7x. In accordance with the present invention, the leading cutter C1 is moved radially inwardly from the original cutting circle 200 by a distance d1 equal to 7x·(16/17), the next cutter C2 is removed radially inwardly by a distance d2 of 7x·(15/17), the next cutter by a distance d3 of 7x·(14/17), and so on, with the trailing cutter C17 moved radially by a distance 7x·(0/17)=0. Thus, each cutter C1–C17 will cut its own usual thickness x plus one-seventeenth of the residual thickness, i.e., each cutter now cuts x+(7x/17). That eliminates any instantaneously high forces acting on the milling cutter or milling wheel due to the existence of the gap G.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An apparatus for performing cutting and grinding operations on a workpiece, comprising:

a hollow outer spindle mounted to be rotatably driven about a first axis of rotation;

a cutting ring mounted on a front end of said outer spindle for carrying cutters rotatable about said first axis;

an inner spindle disposed within said outer spindle and mounted to be rotatably driven about a second axis extending parallel to said first axis and offset radially there from; and a grinding wheel mounted on a front end of said inner spindle, said grinding wheel including a front grinding surface rotatable about said second axis and orbitable about said first axis.

2. The apparatus according to claim 1 wherein a cutting radius of an outer edge of said grinding surface is substantially equal to a grinding radius of an outer edge of said milling wheel.

3. The apparatus according to claim 1 further including a single motor for driving both of said outer and inner spindles.

4. The apparatus according to claim 3 further including a gear train connected to said motor and said inner and outer spindles for driving said outer and inner spindles at relatively different speeds.

5. The apparatus according to claim 1 wherein said grinding surface is axially displaceable relative to said cutting wheel to adjust an axial relationship between said grinding surface and a cutting path of the cutters.

6. The apparatus according to claim 5 wherein said grinding surface is axially adjustable relative to said inner spindle.

7. The apparatus according to claim 6 further including a hub to which said grinding wheel is mounted, said hub including a mounting portion mounted to said inner spindle, and an elastically flexible connector portion interconnecting said grinding surface and said mounting portion for effecting said axial adjustment of said grinding surface; and an actuator for controlling axial flexing of said mounting portion.

8. The apparatus according to claim 7, wherein said actuator is operable to apply a forward axial force to said connector portion to elastically flex said connector portion axially forwardly from a relaxed state thereof, said actuator effecting said axial adjustment by reducing said forward force to enable said connecting member to flex rearwardly partially to its relaxed state.

9. The apparatus according to claim 1 wherein said grinding wheel includes a front face having generally radially oriented slots, and a fluid passage system communicating with said slots for conducting cooling liquid to said slots to be discharged toward said grinding surface.

10. The apparatus according to claim 1 wherein said milling wheel comprises:

a body defining an axis of rotation; and a plurality of milling cutter elements mounted on said body in circumferentially spaced relationship;

said cutter elements comprising a leading cutter element and a trailing cutter element and intermediate cutter elements disposed therebetween;

a circumferential distance from said leading cutter element to said trailing cutter element in a direction opposite a direction of rotation of said body being occupied by said intermediate cutter elements which are spaced circumferentially apart by generally equal intervals;

a circumferential distance from said leading cutter element to said trailing cutter element in said direction of rotation being substantially greater than any of said intervals;

said cutter elements being spaced radially from said axis by different radial distances, with said leading cutter element having the smallest radial distance, said trailing cutter element having the largest radial distance, and said intermediate cutter elements having progressively increasing radial distances from said leading cutter element to said trailing cutter element.

11. An apparatus for performing cutting and grinding operations on a workpiece, comprising:

a hollow outer spindle rotatable about its longitudinal axis;

a cutting ring mounted on a front end of said outer spindle and carrying cutters rotatable in a cutting path about said axis of said outer spindle;

an inner spindle disposed within said outer spindle and rotatable about its longitudinal axis;

a grinding mechanism mounted on a front end of said inner spindle, said grinding mechanism including a mounting portion connected to said inner spindle, a front grinding surface, and an elastically flexible connector portion interconnecting said mounting portion and said grinding surface to enable said grinding surface to be axially adjusted relative to said cutting path in response to axial flexing of said connector portion; and an actuator for controlling the axial flexing of said connector portion.

12. The apparatus according to claim 11 wherein said actuator is operable to apply a forward axial force to said connector portion to elastically flex said connector portion axially forwardly from a relaxed state thereof, said actuator effecting said axial adjustment by reducing said forward force to enable said connector portion to flex rearwardly partially to its relaxed state.

13. An apparatus for grinding a workpiece, comprising:

a spindle rotatable about a longitudinal axis;

a grinding mechanism including a mounting portion mounted to a forward end of said spindle, a front grinding surface, and an elastically flexible portion interconnecting said grinding surface and said mounting portion to enable said grinding surface to be axially adjusted; and an actuator for controlling axial flexing of said connector portion along said axis;

said mounting portion and said elastically flexible portion being defined by a one-piece member formed of a metallic material, said member being arranged coaxially with said axis, all of said elastically flexible portion disposed radially inside of said mounting portion, said actuator arranged to apply an axial force to a center portion of said member at a location disposed radially inwardly with respect to said elastically flexible portion to displace said center portion axially with respect to said mounting portion.

14. An apparatus for grinding a workpiece, comprising:

a spindle rotatable about a longitudinal axis;

a grinding mechanism including a mounting portion mounted to a forward end of said spindle, a front grinding surface, and an elastically flexible connector portion interconnecting said grinding surface and said mounting portion to enable said grinding surface to be axially adjusted; and an actuator for controlling axial flexing of said connector portion along said axis, said actuator being operable to apply an axial force in a forward direction to said flexible portion to elastically flex said flexible portion axially forwardly from a relaxed state thereof, said actuator effecting said axial adjustment by reducing said forward force to enable said connector portion to flex rearwardly partially to its relaxed state.

* * * * *